US010245707B2

(12) United States Patent
Ryan et al.

(10) Patent No.: US 10,245,707 B2
(45) Date of Patent: Apr. 2, 2019

(54) CONFORMABLE SANDING BLOCK

(71) Applicant: Malco Products, Inc., Annandale, MN (US)

(72) Inventors: John Thomas Ryan, Dassel, MN (US); Anthony Mark Rea, Cedar, MN (US); Scott A. Olson, Chippewa Falls, WI (US); Andrew J. Janetski, Birchwood, WI (US); Tyler Buchanan, Chippewa Falls, WI (US)

(73) Assignee: Malco Products, Inc., Annandale, MN (US)

( * ) Notice: Subject to any disclaimer, the term of this patent is extended or adjusted under 35 U.S.C. 154(b) by 159 days.

(21) Appl. No.: 15/437,790

(22) Filed: Feb. 21, 2017

(65) Prior Publication Data

US 2017/0320194 A1 Nov. 9, 2017

Related U.S. Application Data

(60) Provisional application No. 62/333,453, filed on May 9, 2016.

(51) Int. Cl.
*B24D 15/04* (2006.01)
*B24D 15/02* (2006.01)

(52) U.S. Cl.
CPC ..... *B24D 15/04* (2013.01); *B24D 15/023* (2013.01)

(58) Field of Classification Search
CPC ..... B24D 11/00; B24D 15/023; B24D 15/04; B24D 18/0009; B23D 71/04
USPC ..... 451/490, 495, 523, 524
See application file for complete search history.

(56) References Cited

U.S. PATENT DOCUMENTS 470,794 A * 3/1892 Shempp ..... B24D 15/04 451/495
567,905 A * 9/1896 Locke ..... B24D 15/04 451/495
1,062,214 A * 5/1913 Bergman ..... B24D 15/04 451/495
1,165,452 A * 12/1915 Rudolph ..... B24D 15/04 30/478
2,256,098 A 9/1941 Mauldin
2,414,036 A * 1/1947 Gerhan ..... B24D 15/04 451/512

(Continued)

OTHER PUBLICATIONS

3M Automotive Aftermarket Division, Paper, Sand. Clean Sanding Sheet Rolls.

(Continued)

*Primary Examiner* — Joseph J Hail
*Assistant Examiner* — Arman Milanian
(74) *Attorney, Agent, or Firm* — Briggs and Morgan, P.A.; Gerald E. Helget

(57) ABSTRACT

A conformable sanding block with a longitudinal axis has a locking end cap, a sliding end cap and a series of indexable segments therebetween. A flexible position rod is fastened to both end caps and passes through and captures each indexable segments forming the ergonomically conformable sanding block that is settable between concave and convex shapes for sanding contoured shapes. The sanding block has a bottom whereat a sandpaper holder is releasably and slidably attached for releaseably fastening sandpaper thereto.

19 Claims, 8 Drawing Sheets

(56) References Cited

U.S. PATENT DOCUMENTS

| | | | | | |
|---|---|---|---|---|---|
| 3,123,947 | A * | 3/1964 | Rawley | B24D 15/04 | 15/235.8 |
| 3,557,496 | A * | 1/1971 | Martin | B24D 15/04 | 451/523 |
| 4,206,574 | A | 6/1980 | Dotsko | | |
| 4,640,060 | A | 2/1987 | Lukianoff | | |
| 4,671,019 | A | 6/1987 | Hutchins | | |
| 4,671,020 | A | 6/1987 | Hutchins | | |
| 4,839,995 | A | 6/1989 | Hutchins | | |
| 4,887,396 | A | 12/1989 | Lukianoff | | |
| 5,005,005 | A | 4/1991 | Brossia et al. | | |
| 5,007,483 | A | 4/1991 | McGuire | | |
| 5,022,190 | A | 6/1991 | Hutchins | | |
| 5,131,193 | A * | 7/1992 | Demers | B24D 15/023 | 451/490 |
| 5,203,123 | A * | 4/1993 | Travis | B24D 15/04 | 451/490 |
| 5,337,523 | A * | 8/1994 | Walsh | B24D 15/04 | 15/245 |
| 5,662,519 | A * | 9/1997 | Arnold | B24D 15/04 | 451/495 |
| 5,669,808 | A * | 9/1997 | Simons | B23D 67/12 | 29/76.1 |
| 6,261,031 | B1 | 7/2001 | Stipe et al. | | |
| 6,283,842 | B1 * | 9/2001 | Collins | B24B 23/04 | 451/495 |
| 6,544,113 | B1 * | 4/2003 | Wheeler | B24D 15/04 | 451/495 |
| 7,229,346 | B1 * | 6/2007 | Minker | A47L 13/18 | 15/227 |
| 7,297,049 | B2 * | 11/2007 | Pontieri | B23D 61/185 | 451/523 |
| 8,062,101 | B1 | 11/2011 | Friend | | |
| 8,834,235 | B1 * | 9/2014 | Foster | B24D 15/04 | 451/344 |
| 9,156,135 | B1 * | 10/2015 | Foster | B24D 15/04 | |
| 2002/0086627 | A1 * | 7/2002 | Andrews | B24B 21/02 | 451/355 |
| 2011/0271476 | A1 * | 11/2011 | Robideau | B05C 17/10 | 15/245.1 |
| 2015/0283632 | A1 * | 10/2015 | Ursuliak | B23D 71/04 | 29/76.1 |

OTHER PUBLICATIONS

Greenlight Surfboard Supply, Hook & Loop Sandpaper Strips for Sanding Blocks, Dec. 20, 2016.
Wurth, Flex Sanders, Feb. 2012.

* cited by examiner

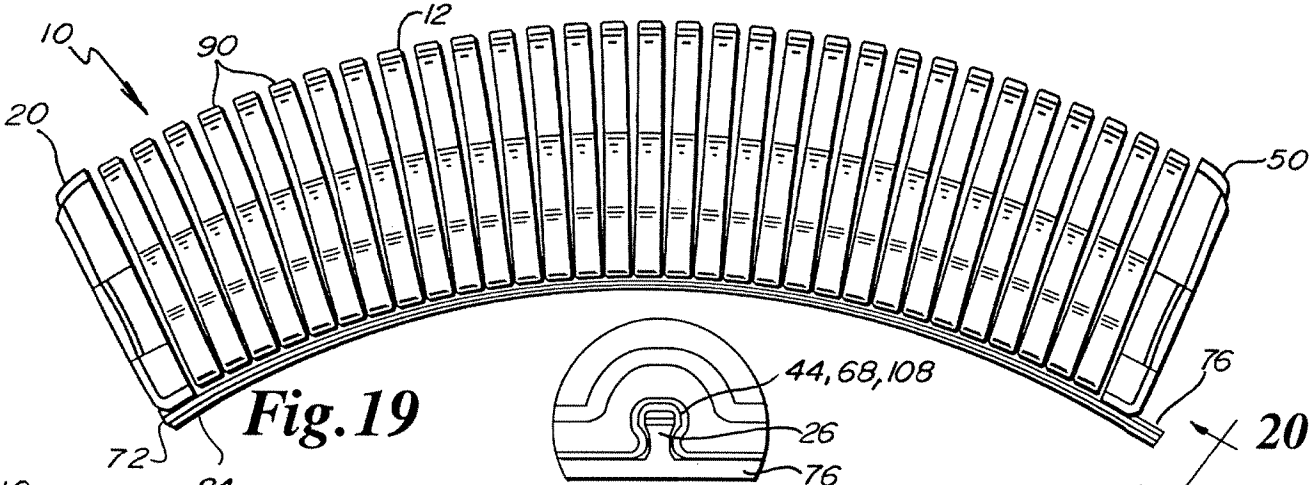
Fig. 19
Fig. 20
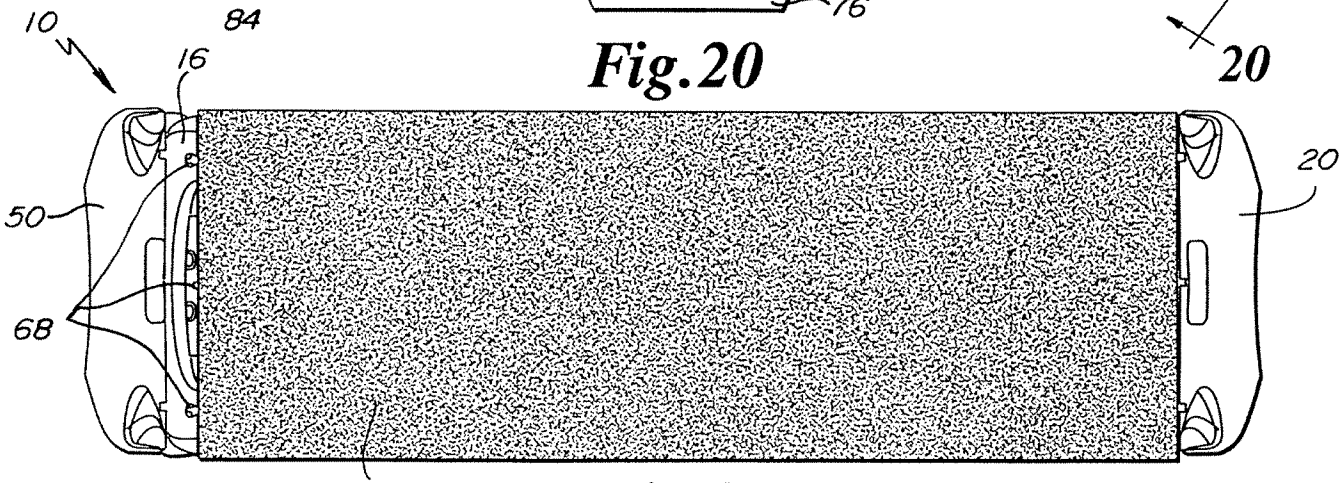
Fig. 21

CONFORMABLE SANDING BLOCK

BACKGROUND OF THE INVENTION

The present invention relates to supports commonly used with sandpaper for smoothening out scratches, ripples and undulations defined along a flat to curved surface of an object to be smoothened. More particularly, this invention relates to a hand operated conformable sanding block that will hold sandpaper in unwrinkled, creased or buckled condition while conforming to and maintaining a desired shape during a sanding operation.

Rigid sanding blocks that hold or grip sand paper are well known for sanding flat surfaces. Some are manually operated while others may be motorized to impart vibration or oscillation to the sand paper to aid in smoothening a flat surface. These sanding blocks do not work well with curved surfaces such as with automobiles that have significant contouring to their outer auto body. There are curved edge sanding blocks that are generally rigid and work for the limited purpose of sanding contoured but straight edges.

Deformable or conformable sanding blocks are also used with curved surfaces to be sanded. Some of these conformable sanding blocks can be shaped to conform to the surfaces to be sanded and may also have a shape retaining metallic core to keep the block in a particular shape but have their own problems. If the sandpaper is applied to the block in a relatively flat condition the sandpaper is subject to tearing, wrinkling, creasing and/or buckling when the block is deformed to a particular surface. Sanding with the block and sandpaper in this condition results in a uneven results and possibly even gouging of the surface to be sanded. Placing the sandpaper onto the block after it has be deformed literally locks the block into it particular shape requiring the sandpaper to be removed to change the shape of the block. This is a problem because contouring on many surfaces, like those of automobiles, changes quite frequently. This problem requires frequent sandpaper removal from the block and re-shaping of the block followed by re-adhering the sandpaper to the reshaped block. This effort is time consuming. Another problem with these deformable sanding blocks is that they are of an unchangeable fixed length making them unusable in some applications thereby requiring additional sand blocks of various lengths to be on hand by the sanding operator.

There is a need for a conformable sanding block that is adjustable in length and has a range of maintainable conformable shapes from concave to convex and variations therebetween up to a radius that is generally equal to about 8.5 inches. The sandpaper should not require removal and re-adherence with each shape change but should be quickly and automatically re-settable with relative ease without buckling, tearing, wrinkling and/or creasing of the sand paper with any shape change of the conformable sanding block. The conformable sanding block should also not allow the sandpaper to move during use creating a rigid sanding face. The block should also be ergonomic to reduce hand fatigue.

SUMMARY OF THE INVENTION

A conformable sanding block with a longitudinal axis has a locking end cap, a sliding end cap and a series of indexable segments therebetween. A flexible position rod is fastened to both end caps and passes through and captures each indexable segments forming the ergonomically conformable sanding block that is settable between concave and convex shapes for sanding contoured shapes. The sanding block has a bottom whereat a sandpaper holder is releasably and slidably attached for releaseably fastening sandpaper thereto.

A principal object and advantage of the present invention is that it assures even sanding with a block contour that can be quickly re-set with relative ease.

Another object and advantage of the present invention is that the block contour can be changed without the sandpaper buckling, tearing, wrinkling or creasing.

Another object and advantage of the present invention is that sandpaper holder is releasably and slidably attached to the block for releaseably fastening sandpaper thereto without sandpaper holder removal.

Another object and advantage of the present invention is that the sanding block settable between concave and convex shapes and holds it shape for sanding contoured shapes;

Another object and advantage of the present invention is that the sanding block does not allow the sandpaper to move during use creating a rigid sanding face.

Another object and advantage of the present invention is that the sanding block is ergonomic to reduce hand fatigue.

Another object and advantage of the present invention is that the sanding block does not require that the sandpaper be removed and re-adhered with each shape change.

Another object and advantage of the present invention is that the sanding block allows for its length to be adjusted to be longer or shorter.

BRIEF DESCRIPTION OF THE DRAWINGS

FIG. 19 is a side elevational view of the conformable sanding block in a concave condition for sanding a contoured object;

FIG. 20 is an enlarged end view taken along lines 20-20 of FIG. 16 showing the engagement in detail of the profiled slots of the sliding end cap and the ribs of the sandpaper holder;

FIG. 21 is a bottom plan view of the conformable sanding block in a concave condition for sanding a contoured object showing the sandpaper holder slidably moved (right side) to accommodate this condition;

DETAILED SPECIFICATION

Figure 1:
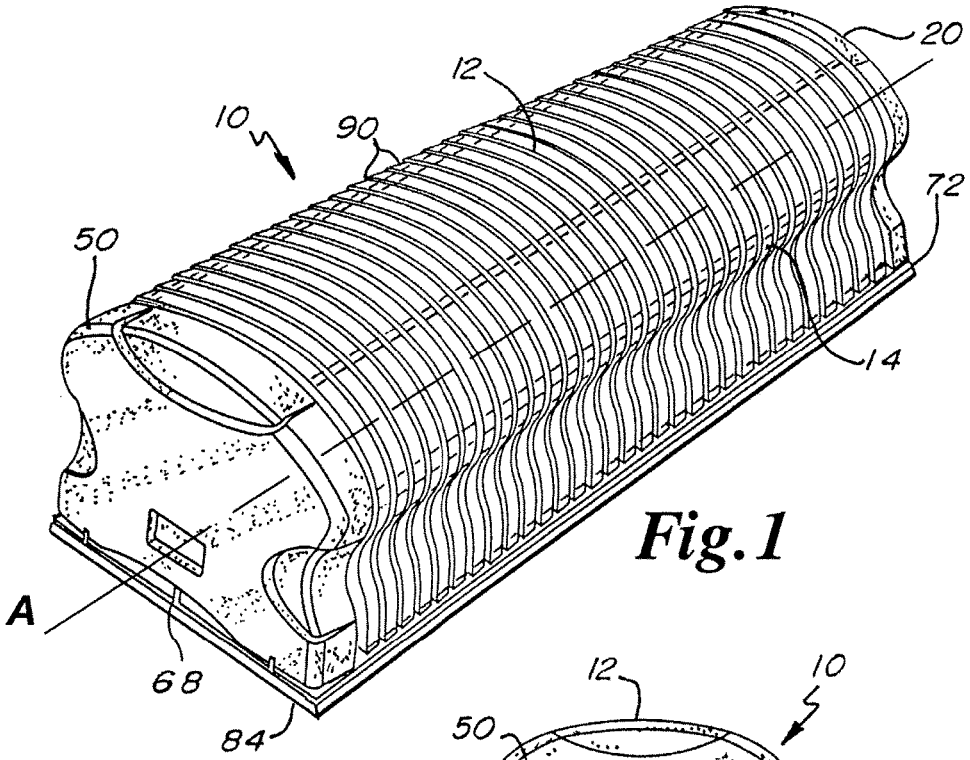
FIG. 1 is a perspective view of the conformable sanding block with its longitudinal axis A.
Figure 2:
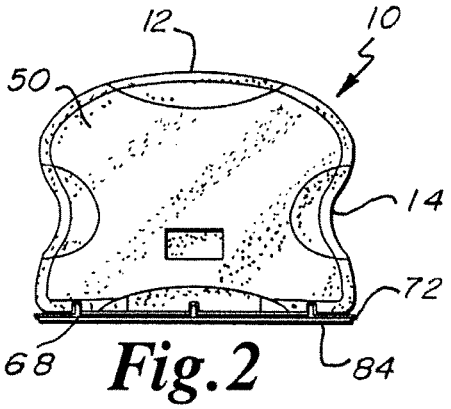
FIG. 2 is an end view of the invention showing the sliding end cap.
Figure 3:
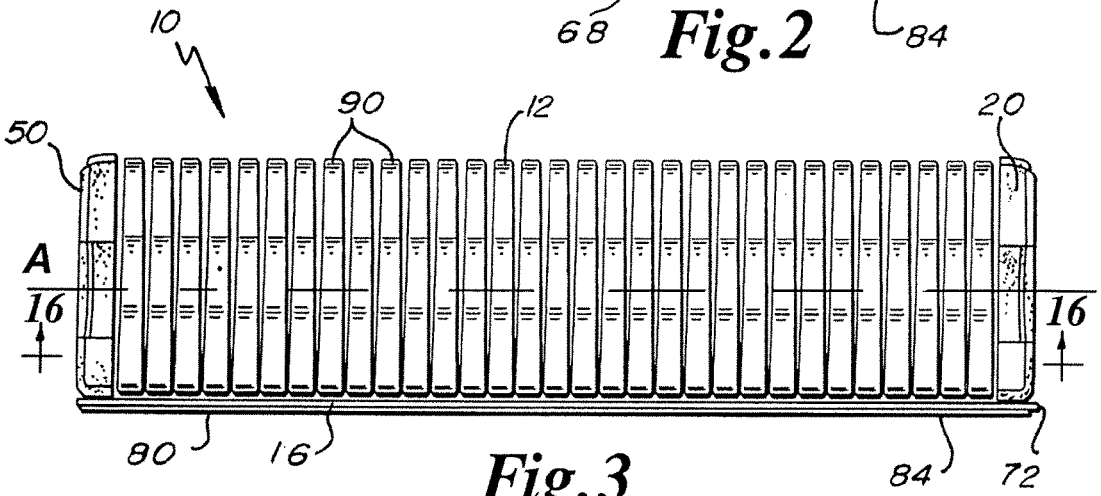
FIG. 3 is a side elevational view which is a mirror image of the other side.
Figure 4:
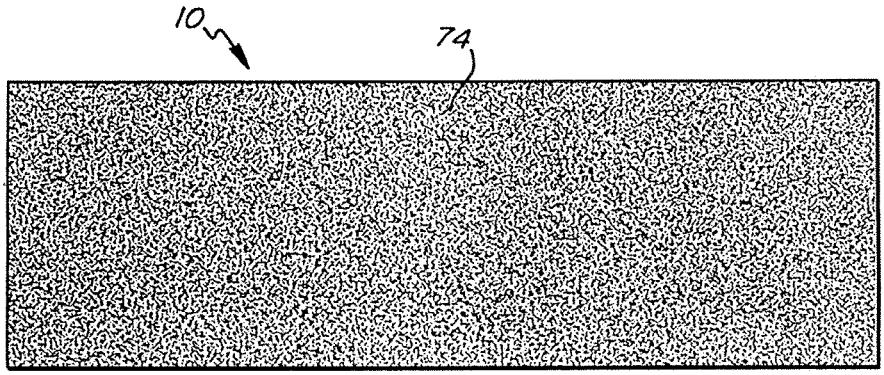
FIG. 4 is a bottom plan view of the invention.
Figure 5:
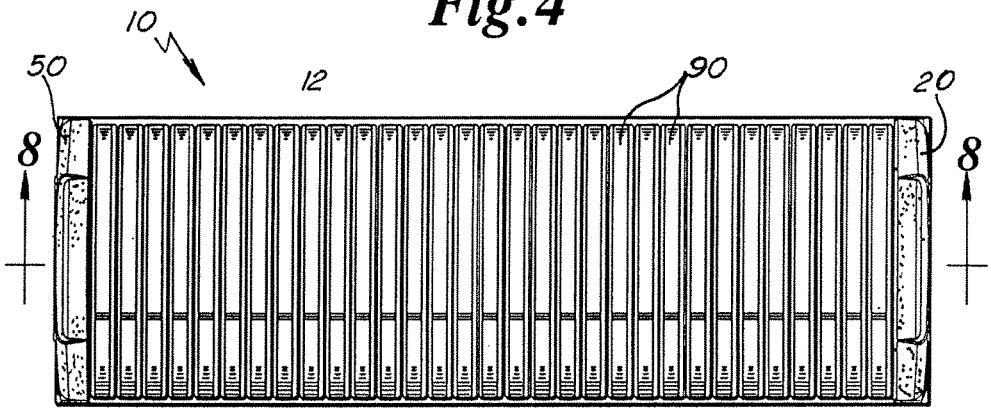
FIG. 5 is a top plan view of the invention.

Referring to FIGS. 1 through 7, the conformable sanding block 10 of the present invention may generally be understood. Block 10 has a longitudinal reference axis A. at one end of block 10 is located locking end cap 20. At the other end along Axis A is located a sliding end cap 50 with a series of indexable segments 90 therebetween. The sanding block is ergonomic in that it has a contoured shape with a top hand grip surface 12 and side finger and thumb depressions 14. A flexible position rod 28 is fastened to both end caps 20 and 50 and passes through and captures each of the indexable segments 90 forming the ergonomically conformable sanding block 10 that is settable between concave and convex shapes for sanding contoured shapes (seen in FIGS. 17, 19 and 22). The rod 28 is suitably made of aluminum or other bendable material that will retain its shape after bending and is capable of long term bending wear. The sanding block 10 has a bottom 16 whereat a sandpaper holder 72 is releasably and slidably attach for releaseably fastening sandpaper 84 thereto. This unique attachment is accomplished by a series of profiled slots 44, 68 and 108 in the block bottom 16 in conjunction with mating profiled ribs 76 on the sandpaper holder 72.

Referring to FIGS. 1, 3, 5, 8-10 and 16, the details of the conformable sanding block's 10 locking end cap 20 may be appreciated. Locking end cap 20 has finger and thumb grip depressions 22 and a flexible position member 28 securing pocket 24. The flexible position member 28 has parallel end apertures 30. Screw pockets 26 are provided for securing the position member 28 in pocket 24 by way of screws 32 passing through the member parallel end apertures 30 into screw pockets 26. Fulcrum points, shown in enlarged detail in FIG. 15, comprise radiused stirrups 36 with a central slot 38 which pivotally match up with opposing radiused tab 40 having a central index tongue 42. At the bottom 43 of locking end cap 20 are located two profiled or contoured slots 44 which will receive and slidably hold profiled ribs 76 of the sandpaper holder 72. Restraining indexes 46 lock with the constraining notches 78 at the locking end of the sandpaper holder 72.

Referring to FIGS. 1, 2, 3, 5, 8, 11, 12 and 16, the sliding end cap 50 may be understood and appreciated. Sliding end cap 50 has finger and thumb grip depressions 52 and a flexible position member 28 securing pocket 54. Screw pockets 56 are provided for securing the position member 28 in pocket 54 by way of screws 32 passing through the member parallel end apertures 30 into screw pockets 56. Fulcrum points 58, shown in enlarged detail in FIG. 15, comprise radiused stirrups 60 with a central slot 62 which pivotally match up with opposing radiused tab 64 with a central index tongue 66. At the bottom 67 of locking end cap 20 are located three profiled or contoured slots 68 which will receive and slidably hold profiled ribs 76 of the sandpaper holder 72. There are no restraining index locks in the sliding end cap 50 as to permit the profiled ribs 76 on sandpaper holder 72 to freely slide to and fro in relation to the sliding end cap 50.

Referring to FIGS. 4, 7, 8 and 17-23, the details of the sandpaper holder 72 may be seen. The holder 72 uses hook and loop fastening technology to removably fasten sandpaper 84 thereto. Sandpaper 84 with hook fasteners 86 on the opposite side from the grit side of the sandpaper is commercially and readily available. The bottom of the sandpaper holder 72 has complimentary loop fasteners 74.

Referring to FIGS. 1, 3, 5, 6, 8, 13-17 and 23, the expandable indexing segments 90 may be understood and appreciated. Expandable indexing segments 90 have finger and thumb grip depressions 92 and a flexible position member 28 secured or captured in slots 94. A central opening 96 minimizes material and adds to the conformable sliding block's 10 light weight to minimize fatigue. Fulcrum points 98 comprise radiused stirrups 100 with a central slot 102 which pivotally match up with opposing radiused tab 104 with a central index tongue 106. At the bottom of indexing segments are located three profiled or contoured slots 108 which will receive and slidably hold profiled ribs 76 of the sandpaper holder 72. There are no restraining index locks in the expandable indexing segments 90 as to permit the profiled ribs 76 on sandpaper holder 72 to freely slide to and fro in relation to the expandable indexing segments 90. Virtually any number of expandable indexing segments 90 may be used between end caps 20 and 50 captured by the flexible position member or rod 28. By this arrangement, the length of the conformable sanding block 10 is adjustable along axis A.

Figure 6:
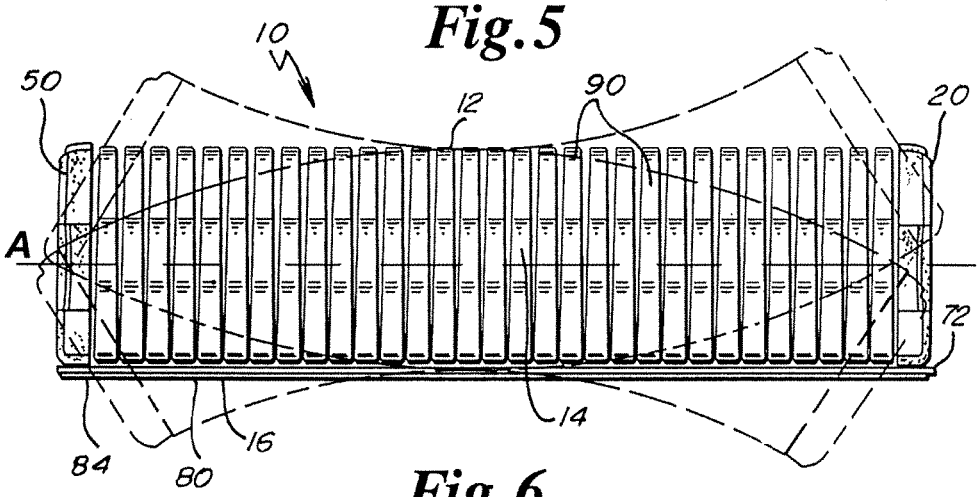
FIG. 6 is a side elevational view of the sanding block showing the block's concave and convex positions in phantom outline.
Figure 7:
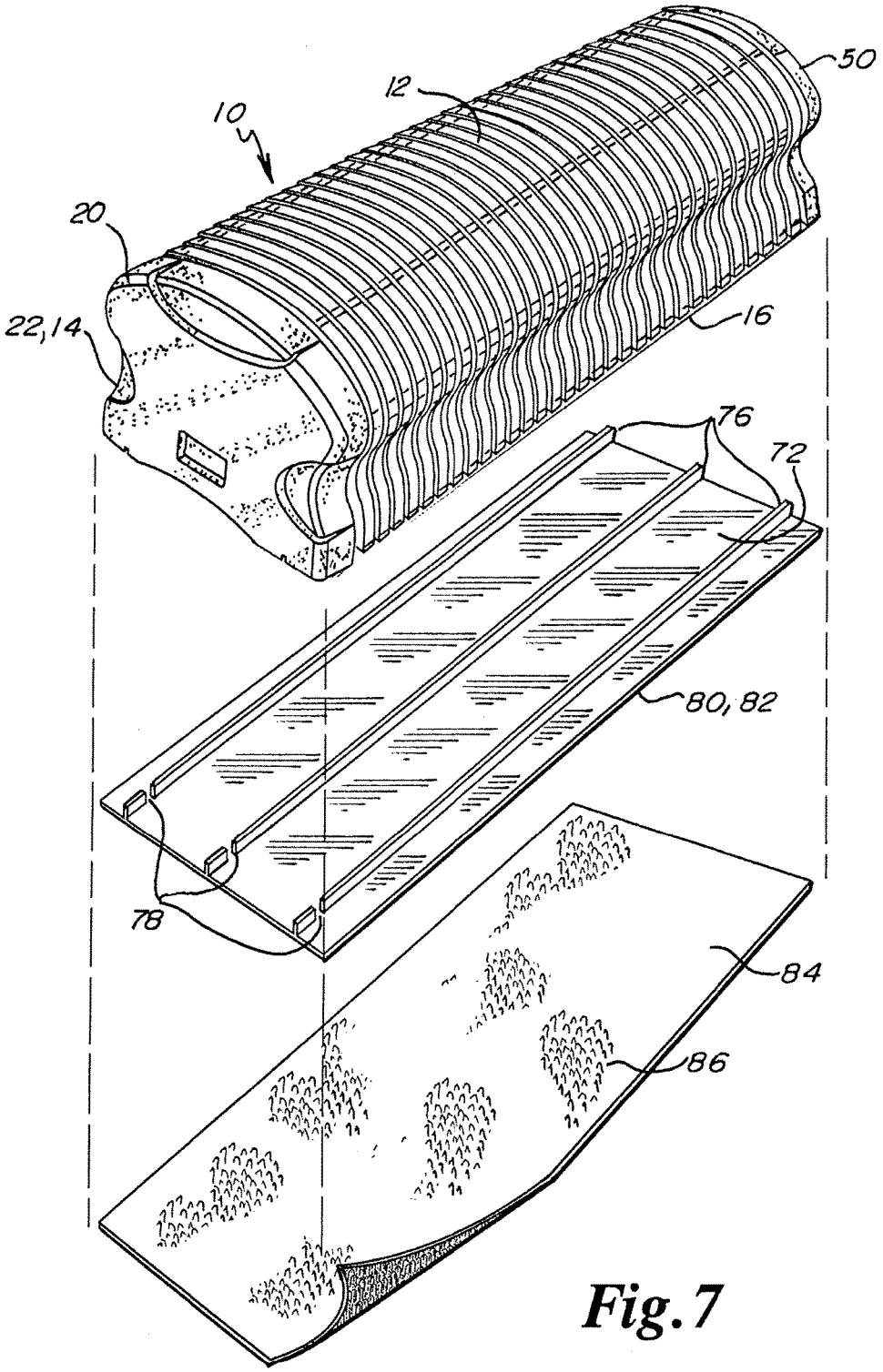
FIG. 7 is an exploded perspective view of the conformable sanding block.
Figure 8:
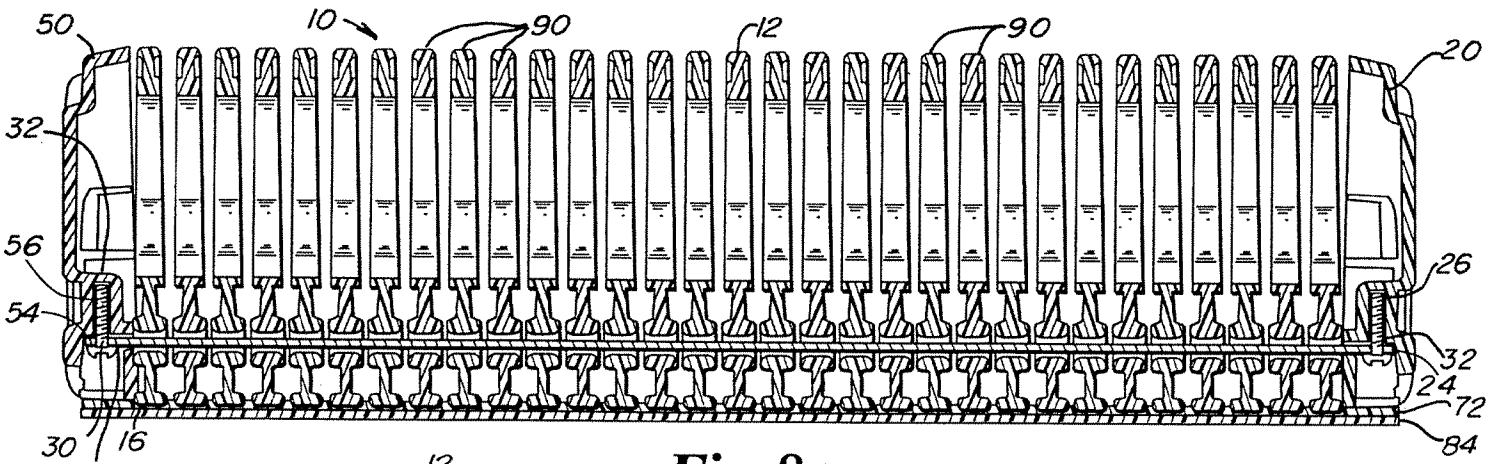
FIG. 8 is a cross sectional view taken along lines 8-8 of FIG. 5.
Figure 11:
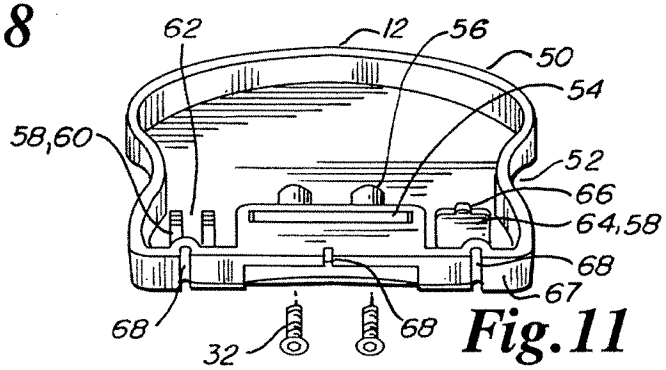
FIG. 11 is a side elevational view of the inside of the sliding end cap slightly tipped rearwardly.
Figure 12:
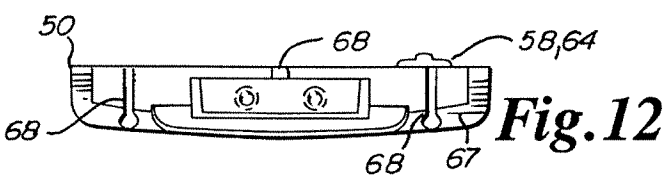
FIG. 12 is a bottom plan view of the sliding end cap.
Figure 9:
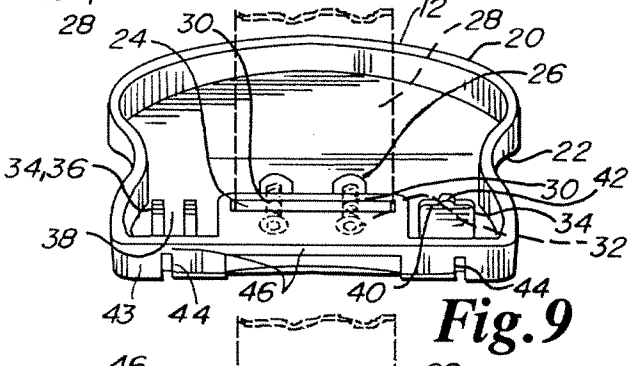
FIG. 9 is a side elevational view of the inside of the locking end cap slightly tipped rearwardly.
Figure 10:
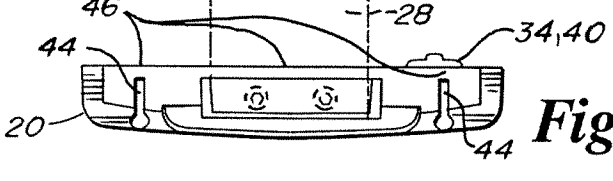
FIG. 10 is a bottom plan view of the locking end cap.
Figure 13:
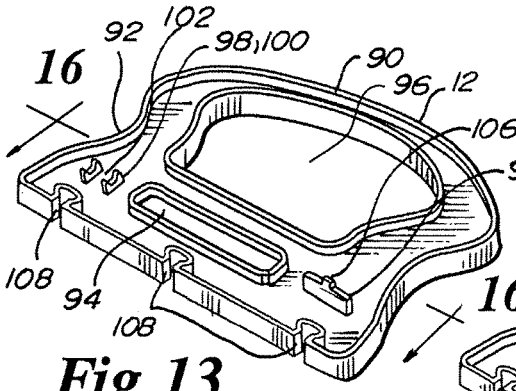
FIGS. 13 and 14 are perspective views of the expandable indexing segments which are all the same.
Figure 14:
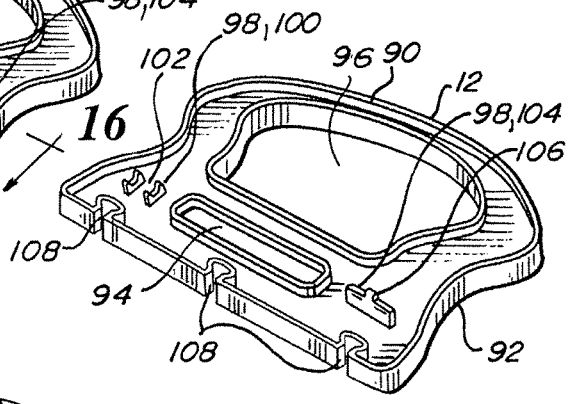
Figure 15:
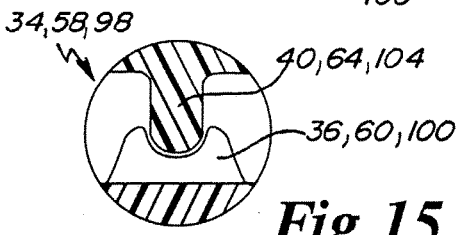
FIG. 15 is an enlarged detailed cross sectional view of one of the fulcrum points of the present invention.
Figure 16:
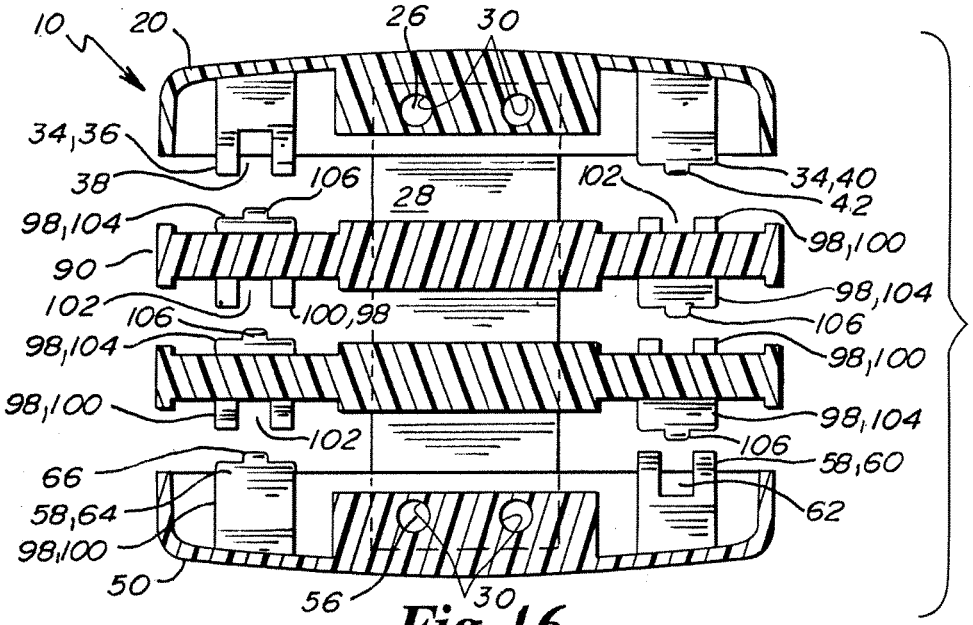
FIG. 16 is a cross sectional view taken along lines 16-16 of FIG. 3.
Figure 17:
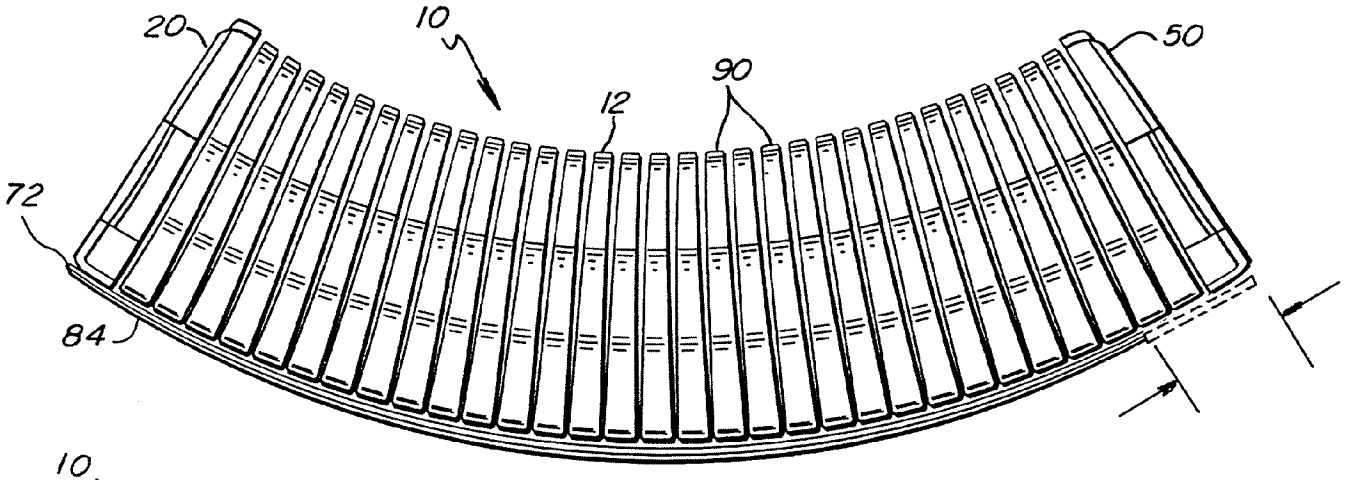
FIG. 17 is a side elevational view of the conformable sanding block in a convex condition for sanding a contoured object.
Figure 18:
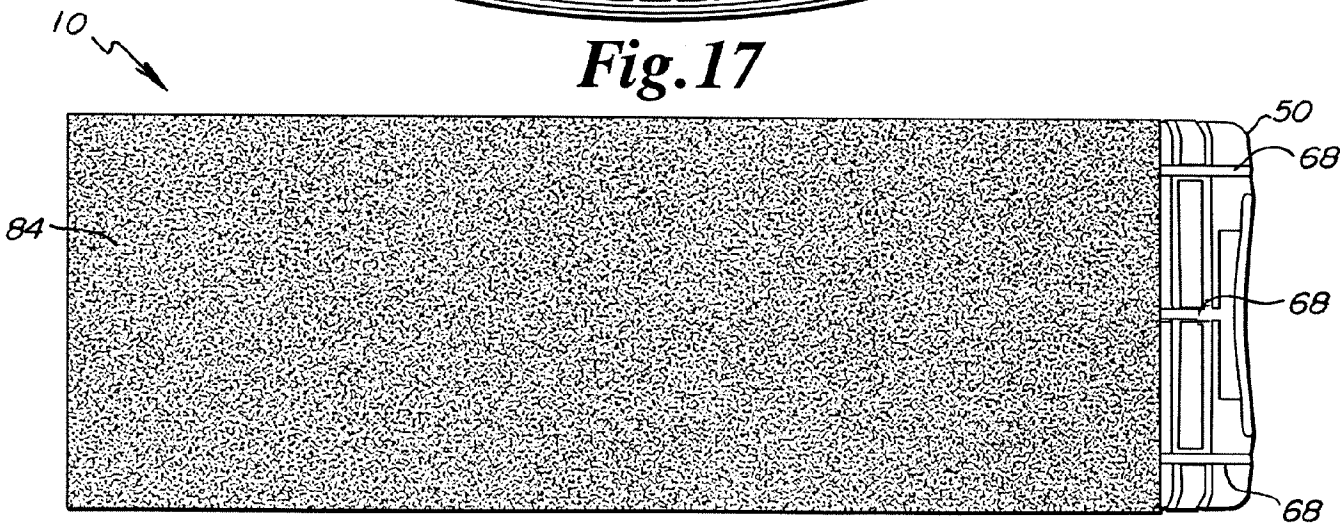
FIG. 18 is a bottom plan view of the conformable sanding block in a convex condition for sanding a contoured object showing the sandpaper holder slidably moved (in phantom) to accommodate this condition.
Figure 22:
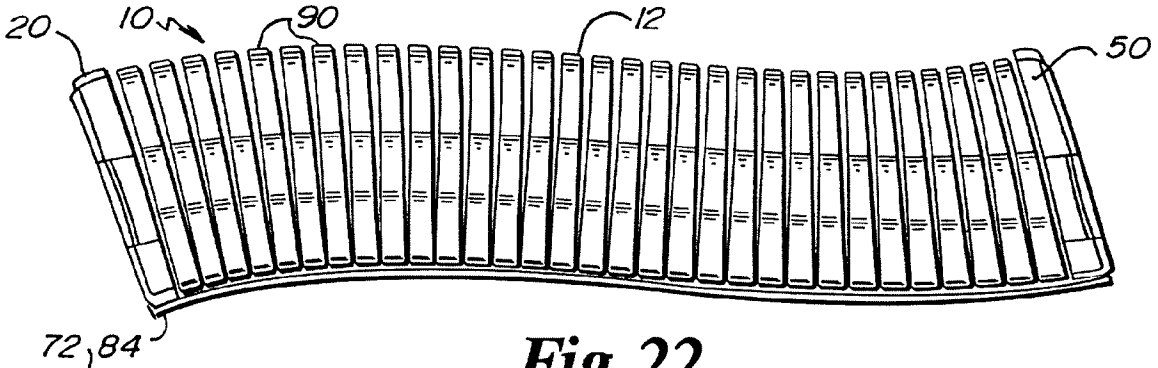
FIG. 22 is a side elevational view of the conformable sanding block in both a concave and convex condition for sanding a contoured object.
Figure 23:
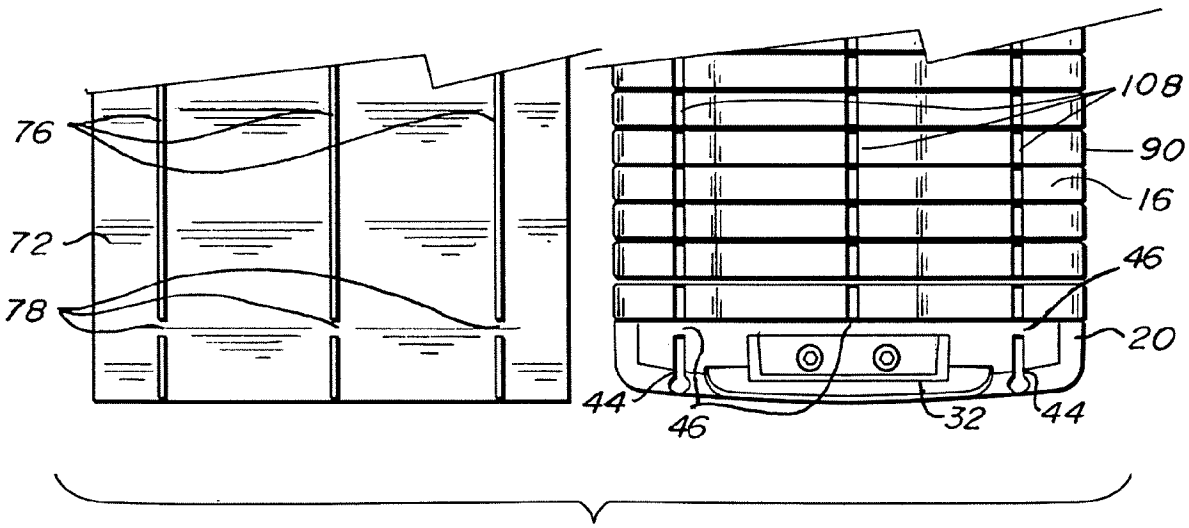
FIG. 23 is a broken away bottom plan view of the conformable sanding block showing the profiled slots and the sandpaper holder removed from the block with the exposed raised profiled ribs and constraining notches.

FIGS. 15 and 16 show how the fulcrum points 34, 58 and 98 of the segments 90 and end caps 20 and 50 comprising stirrups 36, 60 and 100 and radiused tabs 40, 64 and 104 line up and contact each other in pivotal fashion. The outer most segments 90 contact the fulcrum points 34 and 58 of the respective locking end cap 20 and sliding end cap 50 as all is being held together by the flexible position rod 28 secured to end caps 20 and 50 as previously described. Further by this arrangement, the conformable sanding block 10 can take a convex condition, as shown in FIGS. 6 and 17; a concave condition, as shown in FIGS. 6 and 19; or, any position therebetween as shown in FIG. 22 with the flexible position rod 28 holding the block 10 in that shape until the operator changes the shape of the block 10.

FIGS. 17-23 show how the sand paper holder 72 with sandpaper 84 is moved while being locked to the locking end cap 20 by way of the constraining notches 78 being interlocked with the restraining indexes 46 of the locking end cap 20. The profiled ribs 76 of the sand paper holder 72 can freely slide in the profiled slots of the 108 and 68 of the expandable indexing segments 90 and sliding end cap 50, respectively. Thus, the sandpaper holder 72, with its sandpaper 84 held in place by the loops 74 and hooks 86, moves along the axis A of the sanding block 10 so that the sandpaper 84 does not tear, wrinkle, buckle or crease to assure smooth and even sanding.

The above description and accompanying Figs. are for illustrative purposes as to how the conformable sanding block 10 of the present invention may be assembled and used. The true scope of this invention is defined by the following claims.

What is claimed:

1. A conformable sanding block with a longitudinal axis for sanding contoured-shaped objects, comprising:

a.) a locking end cap;

b.) a sliding end cap;

c.) a series of indexable segments each with a central slot being arranged between the end caps, wherein the end caps and indexable segments each have at least one fulcrum point whereby the end caps and indexable segments pivot upon each other, wherein the fulcrum points comprise radiused stirrups and radiused tabs;

d.) the sanding block has a bottom whereat a sandpaper holder is releasably and slidably attached that is adapted to releaseably fasten sandpaper thereto; and e.) a flexible position rod fastened to both end caps and passing through the central slots of the segments thereby capturing each of the indexable segments forming the conformable sanding block that is settable between concave and convex shapes thereby being adaptable for sanding the contoured-shaped objects without the sandpaper wrinkling, tearing, creasing or buckling.

2. The conformable sanding block of claim 1 wherein the sanding block has a hand grip surface with finger and thumb depressions making the sanding block ergonomic.

3. The conformable sanding block of claim 1 wherein the flexible position rod has a memory to hold into the shape that the rod is set at.

4. The conformable sanding block of claim 1 wherein the radiused stirrups each have a central slot and the radiused tabs each have a central indexing tongue.

5. The conformable sanding block of claim 1 wherein the conformable sanding block is longitudinally expandable along an axis A with more or less indexable segments.

6. The conformable sanding block of claim 1 wherein the bottom of the sanding block and the sandpaper holder have complementary profiled ribs and profiled slots to slidably hold the block and holder together as to prevent the sandpaper from tearing, wrinkling, creasing or buckling when the block changes shape.

7. The conformable sanding block of claim 6 wherein the profiled ribs have constraining notches at one end and the locking end cap have restraining indexes to releaseably fixedly lock the sandpaper holder and locking end cap together.

8. An conformable sanding block with a longitudinal axis for sanding contoured-shaped objects, comprising:

a.) a locking end cap;

b.) a sliding end cap;

c.) a series of indexable segments each with a central slot being arranged between the end caps, wherein the fulcrum points comprise radiused stirrups and radiused tabs, wherein the radiused stirrups each have a central slot and the radiused tabs each have a central indexing tongue;

d.) wherein the end caps and indexable segments each have at least one fulcrum point whereby the end caps and indexable segments pivot upon each other;

e.) the sanding block has a bottom whereat a sandpaper holder is releasably and slidably attached that is adapted to releaseably fasten sandpaper thereto; and f.) a flexible position rod fastened to both end caps and passing through the central slots of the segments thereby capturing each of the indexable segments forming the ergonomically conformable sanding block that is settable between concave and convex shapes thereby being adaptable for sanding the contoured-shaped objects without the sandpaper wrinkling, tearing, creasing or buckling.

9. The conformable sanding block of claim 8 wherein the sanding block has a hand grip surface with finger and thumb depressions making the sanding block ergonomic.

10. The conformable sanding block of claim 8 wherein the flexible position rod has a memory to hold into the shape that the rod is set at.

11. The conformable sanding block of claim 8 wherein the conformable sanding block is longitudinally expandable along an axis A with more or less indexable segments.

12. The conformable sanding block of claim 8 wherein the bottom of the sanding block and the sandpaper holder have complementary profiled ribs and profiled slots to slidably hold the block and holder together as to prevent the sandpaper from tearing, wrinkling, creasing or buckling when the block changes shape.

13. The conformable sanding block of claim 12 wherein the profiled ribs have constraining notches at one end and the locking end cap have restraining indexes to releaseably fixedly lock the sandpaper holder and locking end cap together.

14. An conformable sanding block with a longitudinal axis for sanding contoured-shaped objects, comprising:

a.) a locking end cap;

b.) a sliding end cap;

c.) a series of indexable segments each with a central slot being arranged between the end caps;

d.) wherein the end caps and indexable segments each have at least one fulcrum point, wherein the fulcrum points comprise radiused stirrups and radiused tabs whereby the end caps and indexable segments pivot upon each other;

e.) the sanding block has a bottom whereat a sandpaper holder is releasably and slidably attached by the bottom of the sanding block and the sandpaper holder have complementary profiled ribs and profiled slots to slidably hold the block and holder together as to prevent the sandpaper from tearing, wrinkling, creasing or buckling when the block changes shape, the holder being adapted to releaseably fasten sandpaper thereto; and f) a flexible position rod fastened to both end caps and passing through the central slots of the segments thereby capturing each of the indexable segments forming the ergonomically conformable sanding block that is settable between concave and convex shapes thereby being adaptable for sanding the contoured-shaped objects without the sandpaper wrinkling, tearing, creasing or buckling.

15. The conformable sanding block of claim 14 wherein the sanding block has a hand grip surface with finger and thumb depressions making the sanding block ergonomic.

16. The conformable sanding block of claim 14 wherein the flexible position rod has a memory to hold into the shape that the rod is set at.

17. The conformable sanding block of claim 14 wherein the radiused stirrups each have a central slot and the radiused tabs each have a central indexing tongue.

18. The conformable sanding block of claim 14 wherein the conformable sanding block is longitudinally expandable along an axis A with more or less indexable segments.

19. The conformable sanding block of claim 14 wherein the profiled ribs have constraining notches at one end and the locking end cap have restraining indexes to releaseably fixedly lock the sandpaper holder and locking end cap together.

* * * * *